US009896229B1

(12) United States Patent
Pierson et al.

(10) Patent No.: US 9,896,229 B1
(45) Date of Patent: Feb. 20, 2018

(54) STRETCH WRAPPING APPARATUS AND METHOD

(71) Applicant: Top Tier, Inc., Clackamas, OR (US)

(72) Inventors: Cary Michael Pierson, Milwaukie, OR (US); Nathaniel T. Schenk, Clackamas, OR (US); Stephen L. Heston, West Linn, OR (US)

(73) Assignee: Top Tier, LLC, Clackamas, OR (US)

( * ) Notice: Subject to any disclaimer, the term of this patent is extended or adjusted under 35 U.S.C. 154(b) by 667 days.

(21) Appl. No.: 14/471,932

(22) Filed: Aug. 28, 2014

Related U.S. Application Data

(60) Provisional application No. 61/871,447, filed on Aug. 29, 2013.

(51) Int. Cl.

| | |
|---|---|
| ***G06F 7/00*** | (2006.01) |
| ***B65B 11/04*** | (2006.01) |
| ***B65B 41/12*** | (2006.01) |
| ***B65B 57/04*** | (2006.01) |

(52) U.S. Cl.
CPC ..... *B65B 11/045* (2013.01); *B65B 41/12* (2013.01); *B65B 57/04* (2013.01)

(58) Field of Classification Search
None
See application file for complete search history.

(56) References Cited

U.S. PATENT DOCUMENTS

| | | | |
|---|---|---|---|
| 2,227,398 | A | 12/1940 | Mohl |
| 3,029,571 | A | 4/1962 | Douthit |
| 3,815,313 | A | 6/1974 | Heisler |
| 3,910,005 | A | 10/1975 | Thimon et al. |
| 4,152,879 | A | 5/1979 | Shulman |
| 4,216,640 | A | 8/1980 | Kaufman |
| 4,235,062 | A | 11/1980 | Lancaster et al. |
| 4,271,657 | A | 6/1981 | Lancaster et al. |
| 4,300,326 | A | 11/1981 | Stackhouse |
| 4,387,548 | A | 6/1983 | Lancaster et al. |
| 4,395,255 | A | 7/1983 | Branecky et al. |
| 4,418,510 | A | 12/1983 | Lancaster et al. |
| 4,429,514 | A | 2/1984 | Lancaster et al. |
| 4,432,185 | A | 2/1984 | Geisinger |

(Continued)

OTHER PUBLICATIONS

Declaration of inventor Stephen L. Heston including photographs regarding shrink wrapping apparatus for palletizing system from 2011.

*Primary Examiner* — Yolanda R Cumbess
(74) *Attorney, Agent, or Firm* — Hancock Hughey LLP

(57) ABSTRACT

A stretch wrapping apparatus for use with an automated palletizing machine to securely stabilize loads. A stretch wrapping head feeds pre-stretched wrapping film toward the rotating load and air jets blow the tail of the film onto the load. Relative rotational movement is created between the wrapping head and the load and the free end of the film is unsupported by any mechanical structure and is directed toward the load only with air from the jets. The film attaches to an outer surface the load. Film is dispensed at a rate to provide payout of film that is consistent with the demand as each load corner transitions through its relative distance change from the dispensing point based on calculations intervals. A sensor detects changes in the optical character of the film to determine an out of bounds condition such as a film break.

13 Claims, 5 Drawing Sheets

(56) References Cited

U.S. PATENT DOCUMENTS 4,458,467 A 7/1984 Shulman et al.
4,501,105 A 2/1985 Rogers et al.
4,503,658 A 3/1985 Mouser et al.
4,505,092 A 3/1985 Bowers et al.
4,514,955 A 5/1985 Mouser et al.
4,524,568 A 6/1985 Lancaster et al.
4,590,746 A 5/1986 Humphrey
4,628,667 A 12/1986 Humphrey et al.
4,676,048 A 6/1987 Lancaster et al.
4,693,049 A 9/1987 Humphrey
4,712,354 A 12/1987 Lancaster et al.
4,736,567 A 4/1988 Pienta et al.
4,754,594 A 7/1988 Lancaster
4,761,934 A 8/1988 Lancaster
4,807,427 A 2/1989 Casteel et al.
4,840,006 A 6/1989 Humphrey
4,845,920 A 7/1989 Lancaster
4,905,451 A 3/1990 Jaconelli et al.
4,953,336 A 9/1990 Lancaster et al.
4,991,381 A 2/1991 Simons
5,027,579 A 7/1991 Keip
5,040,356 A 8/1991 Thimon
5,040,359 A 8/1991 Thimon
5,077,956 A 1/1992 Thimon
5,107,657 A 4/1992 Diehl et al.
5,123,230 A 6/1992 Ipmann
5,138,817 A 8/1992 Mowry et al.
5,163,264 A 11/1992 Hannen
5,186,981 A 2/1993 Shellhamer et al.
5,195,296 A 3/1993 Matsumoto
5,195,297 A 3/1993 Lancaster et al.
5,195,301 A 3/1993 Martin Cocher et al.
5,203,136 A 4/1993 Thimon et al.
5,203,139 A 4/1993 Salsburg et al.
5,216,871 A 6/1993 Hannen
5,240,198 A 8/1993 Dorfel
5,301,493 A 4/1994 Chen
5,311,725 A 5/1994 Martin et al.
5,414,979 A 5/1995 Moore et al.
5,447,008 A 9/1995 Martin Cocher
5,450,711 A 9/1995 Martin Cocher
5,463,842 A 11/1995 Lancaster
5,488,814 A 2/1996 Rankin et al.
5,522,203 A 6/1996 Lancaster et al.
5,546,730 A 8/1996 Newell et al.
5,570,564 A 11/1996 Moore et al.
5,572,850 A 11/1996 Lancaster et al.
5,572,855 A 11/1996 Reigrut et al.
5,581,979 A 12/1996 Scherer
5,588,287 A 12/1996 Lerner et al.
5,595,042 A 1/1997 Cappi et al.
5,634,321 A 6/1997 Martin-Cocher et al.
5,653,093 A 8/1997 Delledonne
5,671,593 A 9/1997 Ginestra et al.
5,749,206 A 5/1998 Moore et al.
5,758,470 A 6/1998 Lancaster
5,758,471 A 6/1998 Denley et al.
5,765,344 A 6/1998 Mandeville et al.
5,768,862 A 6/1998 Mauro et al.
5,799,471 A 9/1998 Chen
5,819,503 A 10/1998 Lancaster
5,836,140 A 11/1998 Lancaster
5,850,726 A 12/1998 Degrasse et al.
5,873,214 A 2/1999 Moore et al.
5,875,617 A 3/1999 Scherer
5,884,453 A 3/1999 Ramsey et al.
5,893,258 A 4/1999 Lancaster
5,911,666 A 6/1999 Lancaster et al.
5,941,049 A 8/1999 Lancaster et al.
5,946,884 A * 9/1999 Nordstrom ..... B65B 25/146 53/225
5,953,888 A 9/1999 Martin-Cocher et al.
6,082,081 A 7/2000 Mucha
6,151,863 A 11/2000 Lancaster et al.
6,185,900 B1 2/2001 Martin et al.
6,189,291 B1 2/2001 Martin et al.
6,195,968 B1 3/2001 Marois et al.
RE37,237 E 6/2001 Lancaster et al.
6,253,532 B1 7/2001 Orpen
6,269,610 B1 8/2001 Lancaster et al.
6,286,893 B1 9/2001 Presley
6,289,652 B1 9/2001 Lancaster et al.
6,293,074 B1 9/2001 Lancaster et al.
6,360,512 B1 3/2002 Marois et al.
6,370,839 B1 4/2002 Nakagawa et al.
6,425,228 B2 7/2002 Lancaster et al.
6,449,922 B2 9/2002 Lancaster et al.
6,453,643 B1 9/2002 Beshereini et al.
6,516,591 B1 2/2003 Lancaster et al.
6,550,222 B2 4/2003 DeGrasse
6,698,161 B1 3/2004 Rossi
6,748,718 B2 6/2004 Lancaster et al.
6,772,575 B2 8/2004 Limousin
6,817,164 B2 11/2004 Limousin
6,848,237 B2 2/2005 Lancaster et al.
6,851,252 B2 2/2005 Maki-Rahkola et al.
6,854,247 B2 2/2005 Lancaster et al.
6,880,316 B2 4/2005 Lancaster et al.
6,883,293 B2 4/2005 Lancaster et al.
6,912,830 B2 7/2005 Limousin
6,918,229 B2 7/2005 Lancaster et al.
6,925,776 B2 8/2005 DeGrasse
6,990,784 B2 1/2006 Lancaster et al.
7,047,707 B2 5/2006 Lancaster et al.
7,076,936 B2 7/2006 Limousin
7,089,713 B2 8/2006 Lancaster et al.
7,137,233 B2 11/2006 DeGrasse et al.
7,143,569 B2 12/2006 Limousin
7,155,884 B2 1/2007 Cousins et al.
7,386,968 B2 6/2008 Sperry et al.
7,469,520 B2 12/2008 Lancaster et al.
7,540,128 B2 6/2009 Lancaster et al.
7,568,327 B2 8/2009 Lancaster et al.
7,707,801 B2 5/2010 Lancaster et al.
7,775,016 B2 8/2010 Cousins et al.
7,779,607 B2 8/2010 Lancaster et al.
7,908,830 B2 3/2011 Cousins et al.
8,037,660 B2 10/2011 Lancaster et al.
8,141,327 B2 3/2012 Lancaster
8,145,350 B2 3/2012 Lancaster et al.
8,166,732 B2 5/2012 Cousins et al.
8,272,196 B2 9/2012 Limousin
8,276,346 B2 10/2012 Lancaster et al.
8,276,354 B2 10/2012 Lancaster et al.
2003/0110737 A1 6/2003 Lancaster et al.
2003/0145563 A1 8/2003 Cere
2003/0200732 A1 10/2003 Maki-Rahkola et al.
2004/0031238 A1 2/2004 Cox
2004/0093836 A1* 5/2004 Ouellette ..... B65B 9/02 53/553
2005/0044812 A1 3/2005 Lancaster et al.
2005/0115202 A1 6/2005 Mertz et al.
2006/0248858 A1 11/2006 Lancaster
2006/0254225 A1 11/2006 Lancaster et al.
2006/0289691 A1 12/2006 Forni
2007/0204564 A1 9/2007 Lancaster et al.
2007/0204565 A1 9/2007 Lancaster et al.
2007/0209324 A1 9/2007 Lancaster et al.
2009/0113855 A1* 5/2009 Ouellette ..... B65B 9/02 53/553
2009/0293425 A1 12/2009 Carter et al.
2012/0174533 A1 7/2012 Lancaster
2014/0116006 A1 5/2014 Lancaster et al.
2014/0116007 A1 5/2014 Lancaster et al.
2014/0116008 A1 5/2014 Lancaster et al.

* cited by examiner

STRETCH WRAPPING APPARATUS AND METHOD

TECHNICAL FIELD

The present invention relates to apparatus and methods for wrapping a load, and more specifically, wrapping a palletized load of items with stretch wrapping material.

BACKGROUND

Stretch wrapping is a commonly used method of protecting palletized loads of material for shipping. Described generally, stretch wrapping involves wrapping a specialized film around a stack of items such as cases that have been arranged on a pallet. The film is wrapped around the cases under tension and thereby stabilizes the stack to minimize the risk of damage during shipping. Tension can be provided by the memory recovery of pre-stretched film, and tension may also be created by resistance between the load and film dispenser or a combination of the two.

There are many styles and designs of automated or semi-automated stretch wrapping machines, many of which work in cooperation with automated palletizing machines that build the palletized loads. The stretch wrapping machines provide relative rotation between the palletized load and a dispenser that holds a roll of stretch wrapping film. Typically, either the pallet and load are stationary with the dispenser rotating around the load, or the pallet and load are rotated relative to a stationary dispenser. Either way, the stretch wrapping film is wrapped helically up and down the load under tension to stabilize it.

Stretch wrapping machines are used in highly automated production and packaging lines and must be able to keep up with throughput rates of the other equipment used in the palletizing operation so that the stretch wrapping operation does not slow the overall production. As such, the devices often operate at relatively high production rates themselves. But stretch wrapping is not always a simple operation. For example, it is known that with a rectangular load on a pallet the demand for the stretch wrapping film varies as the corners of the load pass by the film dispensing point: the payout demand for film increases as the corner of the load passes the dispensing point and decreases as the film is being dispensed across the side of the load between corners. In addition to the payout rate, the amount of tension on the film has a direct impact on the stability of the load when completely wrapped. Many stretch wrapping machines use tensioning devices to control the tension on the film. However, tension forces vary with rotational position and as a result, proper tensioning is often difficult to maintain with high throughput rates. When the film breaks for any number of reasons (including excessive tension), the operation of the stretch wrapping device is stopped or slowed while the film is reattached to the load, either automatically or with operator intervention.

There is an ongoing need for improved stretch wrapping devices that balance the needs and challenges of keeping up with production rates while wrapping loads with proper film tension to correctly stabilize the loads.

The present invention comprises an improved apparatus and method for automated stretch wrapping of a palletized load.

BRIEF DESCRIPTION OF THE DRAWINGS

The invention will be better understood and its numerous objects and advantages will be apparent by reference to the following detailed description of the invention when taken in conjunction with the following drawings.

DETAILED DESCRIPTION OF THE ILLUSTRATED EMBODIMENTS

The primary structural components of stretch wrapping apparatus 10 are described first with reference to the drawings. Operational characteristics and functions are then described.

Figure 1:
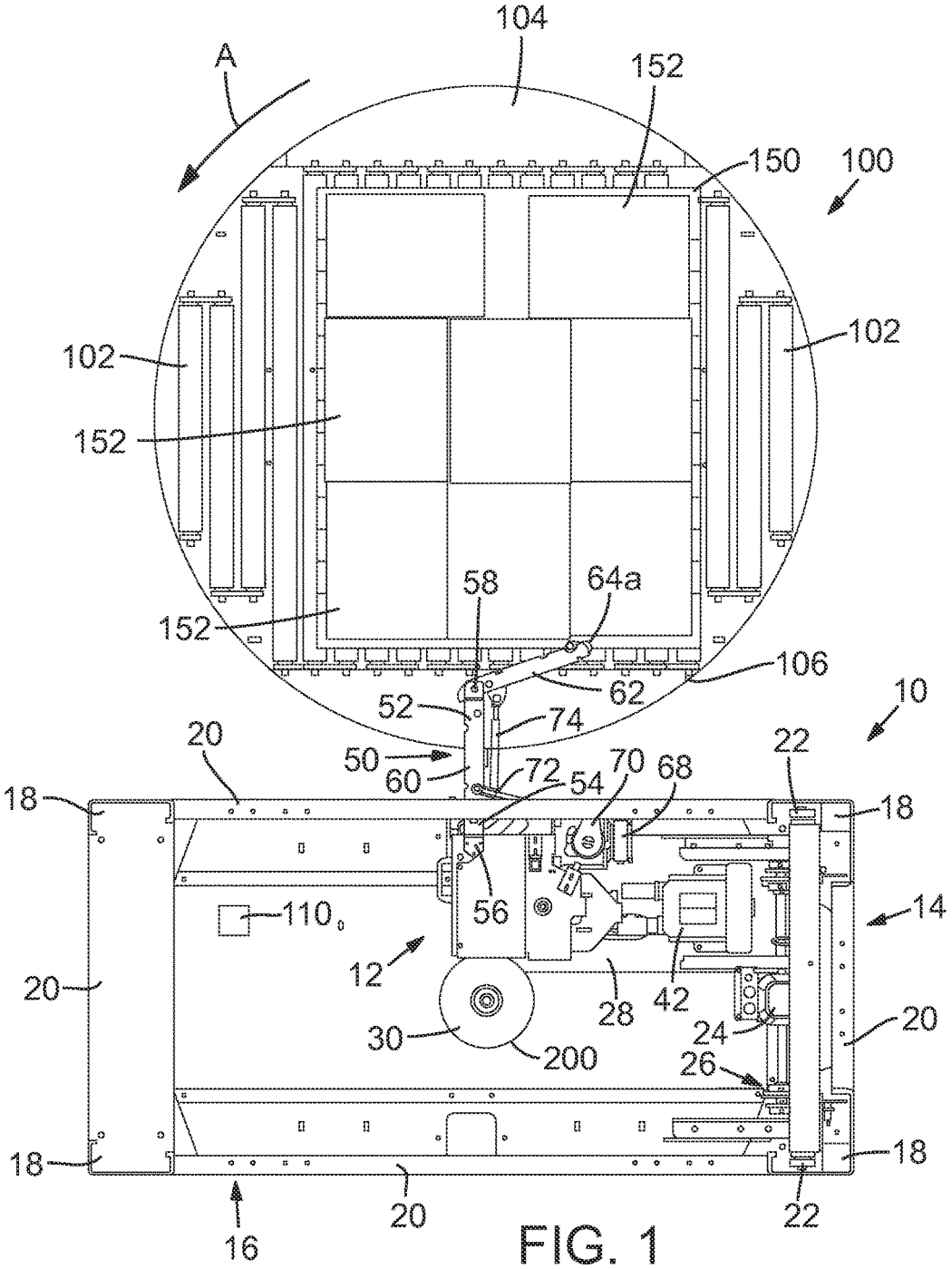
FIG. 1 is a top plan view of a stretch wrapping apparatus according to the present invention, showing the stretch wrapping head mounted in its frame and positioned adjacent to a turntable on which a palletized load is positioned.

Stretch wrapping apparatus 10 generally comprises a stretch wrapping head assembly 12 that is mounted to a carriage assembly 14 that is vertically reciprocally mounted on a frame 16. A turntable 100 is located immediately adjacent stretch wrapping head assembly 12. As seen in FIG. 1, a pallet 150 is operatively positioned on turntable 100 and carries a completed stack of palletized boxes 152. Frame 16 includes vertical corner posts 18 that are interconnected with top rails 20. Carriage assembly 14 defines a movable carriage on which stretch wrapping head assembly 12 is mounted and includes guide rollers 22 that are received in vertical tracks formed in the corner posts 18 in a conventional manner. A carriage lift drive motor 24 is mounted to the carriage assembly 14 and drives vertical reciprocal movement of the carriage assembly with a conventional carriage hoist chain assembly 26.

Stretch wrap head assembly 12 comprises components described below, which are mounted to a horizontal support member 28 that is mounted to carriage assembly 14 so that vertical movement of the carriage assembly directly moves the stretch wrap head assembly. A roll 30 of stretch wrap film 200 is mounted on a mandrel on the support member 28 with the longitudinal axis of the roll vertically oriented relative to the ground plane. A film pre-stretch assembly shown generally at 32 is adjacent the roll 30 and includes a pre-stretch drive motor 34 that drives pair of vertically oriented pre-stretch drive rollers 36. A film guide roller 38 is between the drive rollers 36. In some instances and installations more than one pair of pre-stretch rollers 36 may be used.

The driven rollers 36 define the active film payout mechanism for dispensing the film 200. Film 200 is fed over the film guide roller 38 and then through driven rollers 36. A film sensor 40 is positioned downstream of the film drive rollers 36 and is an optical sensor that detects the presence (or absence) of film and optionally, the relative condition of the film, as detailed below. When pre-stretch film dispensing occurs, the drive rollers rotate at different speeds which pre-stretches film between the adjacent rollers. Non pre-stretch dispensers generally use one driven roller or using relative motion between the load and dispenser, film is pulled directly from the roll that usually has some type of friction clutch to create film tension.

A blower motor 42 is mounted to support member 28 and is plumbed via an air tube that splits and feeds two vertically oriented and parallel film training air jet tubes 44 and 46. The air jet tubes 44 and 46 include plural air jets 48, which are openings through which pressurized air supplied by blower motor 42 is directed in a jet onto film 200, as detailed below, as the film is blown toward the boxes 152 on pallet 150. The air jet tubes 44 and 46 are positioned immediately downstream of the film drive rollers 36 such that film 200 being fed through and traveling through the drive rollers is fed between the two air jet tubes.

Stretch wrap head assembly 12 further comprises a film cut arm assembly 50 that comprises a jointed arm 52 pivotally mounted at its first end 54 to a bracket 56 and having a pivot joint 58 midway along the length of the arm. The jointed arm thus defines a first arm section 60 (the inboard section) and a second arm section 62 pivotally mounted to the first arm section 60. At the distal or outboard end of the second arm section 62 a pair of vertical rolls 64*a* and 64*b* are mounted and a film cut hot wire 66 is strung between the rolls 64*a* and 64*b* such that the hot wire is coincident with the outer tangent between the two rolls 64. Considering the direction of load rotation on turntable 100 (i.e., arrow A, FIG. 1), roll 64*a* is considered to be the downstream roll and roll 64*b* is thus the upstream roll. A film cut arm drive motor 68 has a bell crank 70 mounted to its output shaft and a connecting rod 72 directly attaches the bell crank 70 to first arm section 60 of the jointed arm 52. A gas strut 74 has its inner end connected near the bracket 56 and its second end attached at a bracket to the second arm section 62.

With returning reference to FIG. 1, turntable 100 comprises plural driven rollers 102 mounted on a rotatable base 104. An encoder is shown schematically at 106 and is mounted to turntable 100. Turntable 100 is rotated in the direction of arrow A in FIG. 1 with a turntable drive motor, which is not shown; encoder 106 may be mounted to the drive motor instead of directly to the turntable. Turntable rotation speed and position is known based on encoder feedback. Other types of position indicator(s) may be substituted for encoder 106.

The stretch wrap apparatus 10 and turntable 100 are under the control of a controller, which is shown schematically at 110. Operation of apparatus 10 will now be described in detail. Certain operational parameters and criteria are programmed into controller 110 for each load, i.e., each pallet of boxes 152 that is being stretch wrapped by apparatus 10.

Those operational parameters and criteria include:

a. The film dispensing point remains at a known distance from the center point of turntable 100. As used herein, the film dispensing point is defined as the tangent of the last roller contacting the film as film is dispensed toward the load;

b. The load being wrapped is positioned centered on the turntable;

c. The finished load size dimensions are known from existing data available from the palletizer controller that is building the load. Therefore, the four corners of the load position relative to the dispensing point are calculated by controller 110;

d. Once the turntable 100 begins to rotate the rotation speed is known by data from encoder 106 and corner positions of the load begin to change relative to the dispensing point. The corner positions are calculated using turntable rotation angle as determined by the encoder 106, dispensing point center distance and load size dimensions;

e. The frequency of calculation intervals to determine corner distance from the dispensing point during a full 360 degree turntable rotation is not necessarily fixed, although a higher frequency of calculation intervals per 360 degrees of rotation may improve performance consistency;

f. The corner of the load initially evaluated for dispensing purposes is the closest corner of the load rotating away from the dispensing point (arrow A, FIG. 1);

g. Once the initially evaluated corner passes a point where film starts to engage the next corner of the load based on turntable rotation direction, that new corner becomes the reference point for calculations. The means of corner transition change is also based on calculations performed by controller 110 and is not a result of feedback from a sensor or other means;

h. Using the load length, width, and the distance between the dispensing point and the center of the turntable, controller 110 automatically determines at what turntable position each corner of the load will engage the film and will become the active corner—the "active corner" being that corner of the load that most recently engaged the film;

i. As turntable rotation occurs, film is dispensed at a rate—a payout rate—to provide payout of film that is consistent with the speed the active corner moves away from the dispensing point, hereafter referred to as the demand rate. The demand rate is calculated using the dimensions of the load, the instantaneous position of the turntable, the distance from the center of the turntable to the dispensing point, and the instantaneous speed the turntable is rotating. The rate at which pre-stretched film is paid out by pre-stretch rollers 36 is based on calculated demand (the demand rate) while the presence (and optionally, characteristics) of the film are confirmed by sensor 40. Stated another way, the known rotational speed of the turntable is a variable along with the corner positions of the load to be wrapped relative to the dispensing point so that a calculation of demand rate may be made, and so that film payout rate is controlled to be the same as or near the same as demand rate. In practice there may be variance between the calculated actual demand rate and the film payout rate. However, in all cases the film payout rate is consistent with the demand rate so that the load is not disrupted or displaced by film attachment to the load, or ongoing wrapping;

j. Data used in calculation can be offset from actual to provide compensation for control reaction latency in a forward looking anticipatory manner if needed;

k. Actual calculated film dispensing rates can also be varied with offsets or multiplication factors to slightly increase or decrease payout relative to calculated values;

l. Dispensing film payout at a rate matching or closely matching instantaneous demand of the load being wrapped by mathematically tracking the change in the load's active corner position relative to the dispensing point;

m. Mathematically compensating for helix as the carriage assembly 14 moves vertically relative to the load by tracking the change in film head height relative to the height the film was at when the active corner engaged the film;

n. Applying a post-stretch factor to the result of the above calculations to increase or decrease tension between the load and the pre-stretch head.

o. Should the load not be centered on the turntable, offsetting calculations can be made to compensate and maintain the sequence above. For example, where the load is not centered on the turntable the center of load position is used, and combined with the center of turntable position for load demand calculations.

p. Should load size characteristics not be known from the palletizer or other systems, sensors can be used to determine load size and position on the turntable or operator input at an operator interface station can be used.

With the foregoing parameters being set, the stretch wrapping procedure begins with a pallet 150 having a completed stack of boxes 152 positioned thereupon is moved onto the center of turntable 100 with the assistance of driven rollers 102. The load dimensions are known by controller 110, the data having been transmitted to the controller from the controllers used in the upstream palletizing operation. Blower motor 42 is operating and pressurized air is being blown out of air jets 40 onto a free end of film 200 that is being fed through the pre-stretch drive rollers 36 and through the dispensing point between the air tubes 46 and 48—the free or loose end—i.e., the "tail" of the film 200 is unsupported other than the "support" provided by the pressurized air that is being trained on the film. The tail of the film is thus blown toward the load. Said another way, there are no film gripping systems or film engagement devices associated with controlling the attachment of the film to the load, either initially or later, for example after a break in the film.

During pre-attachment, the film is dispensed by the pre-stretch rollers 36 at the rate at which the film would be dispensed if the film was attached to the load. That payout rate is determined by the controller 100 using the known load dimensions and the known speed at which the load is rotating on the turntable. As the film is paid out by the pre-stretch drive rollers 36 the tail of the film makes contact with a surface of the load that is rotating on the turntable—as noted below, the surface that the film contacts may be a side surface or an upper corner surface. Contact between the film and the load is sustained by the continuous flow of air being blown onto the film and the film attaches to the load after it makes contact, either directly or by virtue of sustained contact between the film and the load. In some instances, depending upon a variety of factors such as environmental factors, the nature of the load, etc., the load may rotate through a complete rotation or more before the film attaches to the load. However, the film will attach given the sustained and continuous air stream from the blower that pushes the film against an outer surface of the load, such that the film makes sustained contact with the load as it rotates. Because the film is being paid out at the rate that would nominally match the demand based on load position, size and rotational speed, when the film ultimately engages the load there is no sudden film tension or pull that can prevent engagement or cause the film to break.

The vertical position of carriage assembly may be initially located near the upper limit of the load so that the tail of the film 200 attaches near the top or on one of the upper corners of the boxes 152. The film is then wrapped in a downward helix; the carriage assembly is moved downward as the turntable rotates. Equally well, the tail of the film 200 may be blown onto a side of the load where it catches quickly in most instances to begin the wrapping operation; the carriage is reciprocated vertically as required to wrap the load. Regardless of the position at which the film tail contacts the load, i.e., on a side surface or an upper corner surface, the film attaches because it is continuously blown into contact with an outer surface of the load by the air from the blower. This may be contrasted with the prior art, where film was blown toward a stationary load and where the film was secured to the load by virtue of capturing the film between the cases and the pallet, or between layers of the cases. In other words, prior uses of air to blow film toward a load required the weight of the load to secure the film between one inner surface (e.g., the pallet or an upper surface of an intermediate layer of cases) and another inner surface (e.g., the lower surface of layer of cases).

Stretch wrap apparatus 10 does not include any tension feedback for controlling or varying the tension applied to film 200 as it is wrapped around the load, and there is no sensor feedback required after the film 200 exits the pre-stretch rollers such as a film break sensor. Nonetheless, sensor 40 does sense if film 200 is not exiting the pre-stretch assembly 32 because the character of the film momentarily changes. As noted, sensor 40 is an optical sensor that is capable of detecting presence and optionally the position or character of film 200. If sensor 40 detects that film is no longer exiting the pre-stretch assembly, it indicates it is likely that the film 200 on roll 30 has run out, or there is some other failure. Optionally, a different type of sensor can be used in place of sensor 40 to detect if the film is actually attached to the load, or detect defects such as partial film tears or holes in the film based on optical characteristics described below. When there is, for example, a break in the film the film flutters in the air streams being blown onto the film. This causes changes in the optical characteristics "seen" by sensor 40 and this is indicative of an out of bounds situation. Further, the sensor 40 senses engagement of the tail of the film to the load by continuous monitoring of the integrity of the film web between the pre-stretch assembly 32 and the load. If film web integrity has been compromised, the problem is detected by sensor 40 (again, by optical characteristic changes) and action will automatically be taken via controller 110 to insure load containment by dispensing additional film in the area of the load where the film defect was encountered in order to, for example, overwrap the portion of the load where the break occurred to insure complete film wrapping of the entire load. Sensor 40 is described above as an optical sensor, but other sensor technologies exist that may be used instead, such as ultrasonics.

Blower motor 42 is operated continuously during the entire stretch wrapping cycle for a load, beginning with blowing the tail of the film 200 onto the load for its initial attachment and continuing until the load is completely wrapped and the film is cut, as described below. In the event of a break in the film during the wrapping cycle, the air stream trained onto the new tail of the film 200 causes the film to reattach to the load so that wrapping continues until complete. In addition, in the event of a break the film wrap sequence is adjusted to overwrap the portion of the load where the film break has occurred. This insures that the entire load is stabilized and contained with film and may involve adjustment of the vertical position of carriage assembly. The blower system combined with the payout system thus defines an automatic film re-engagement device for recovery from film breaks.

Film training from the blower may be turned off as an energy savings measure if desired after film engagement and reenergize should sensor 40 sense an out of bounds condition.

Figure 2:
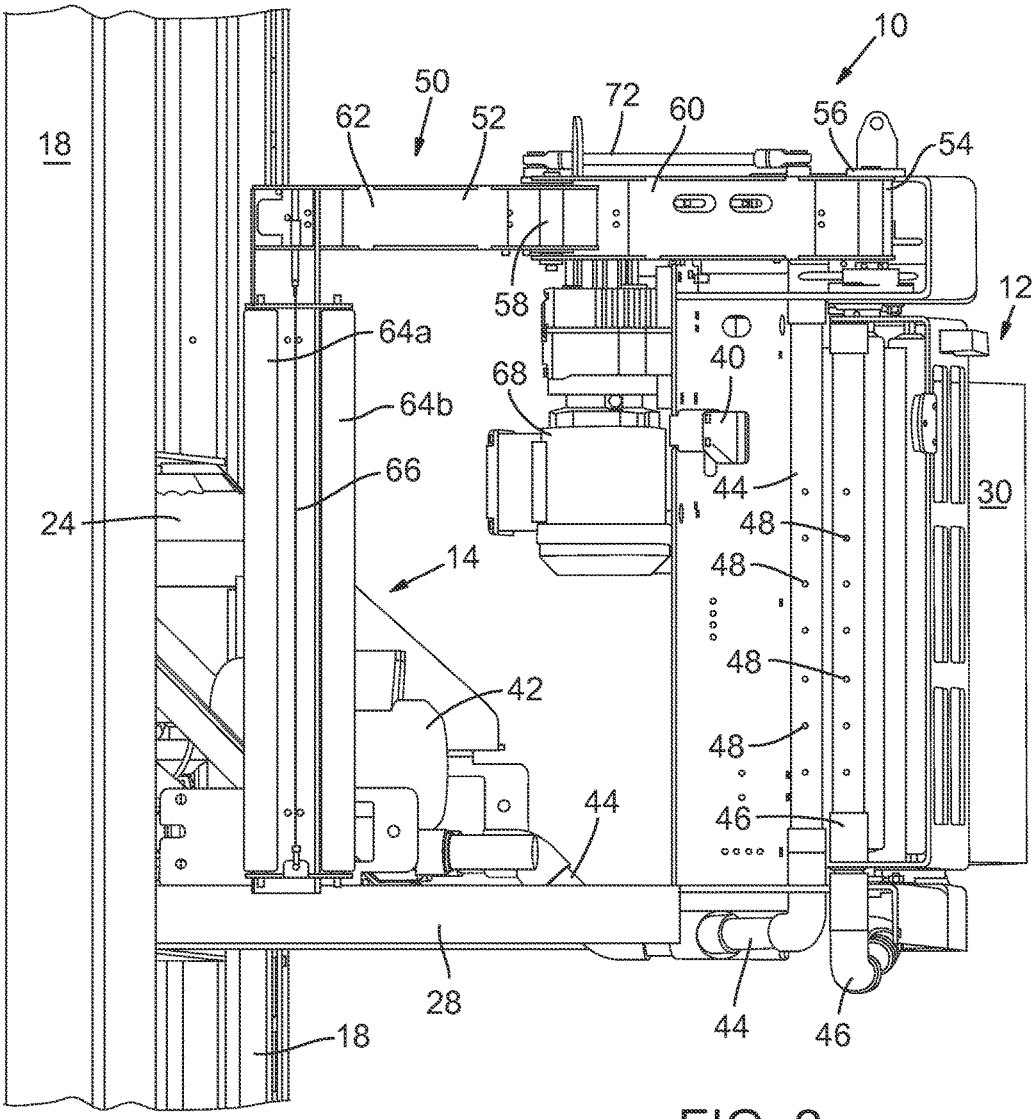
FIG. 2 is side elevation view of the stretch wrapping head and carriage assembly, illustrating portions of the mounting frame.
Figure 3:
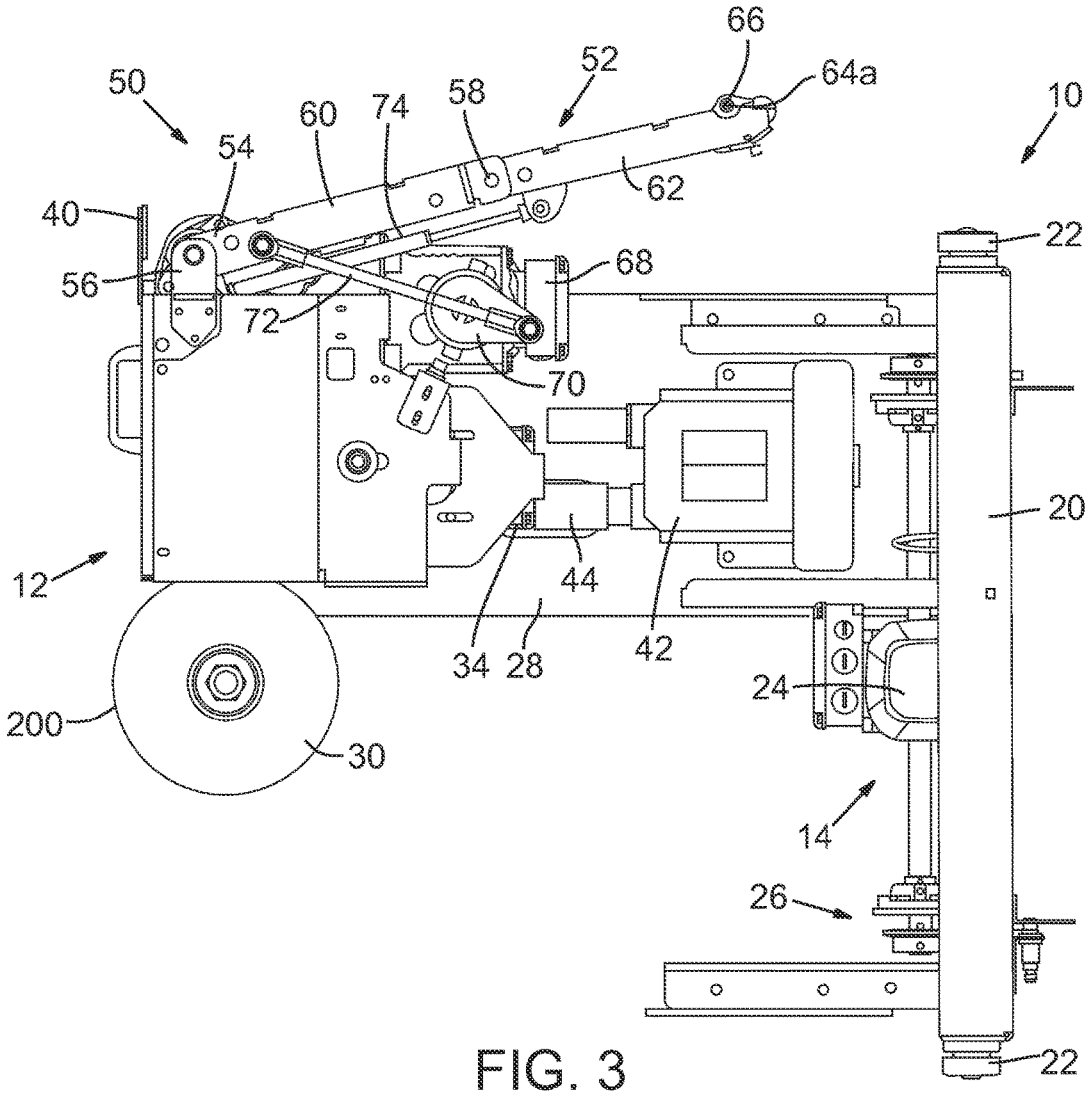
FIG. 3 is a top plan view of the stretch wrapping head and carriage assembly shown in FIG. 2, with the frame elements removed.
Figure 4:
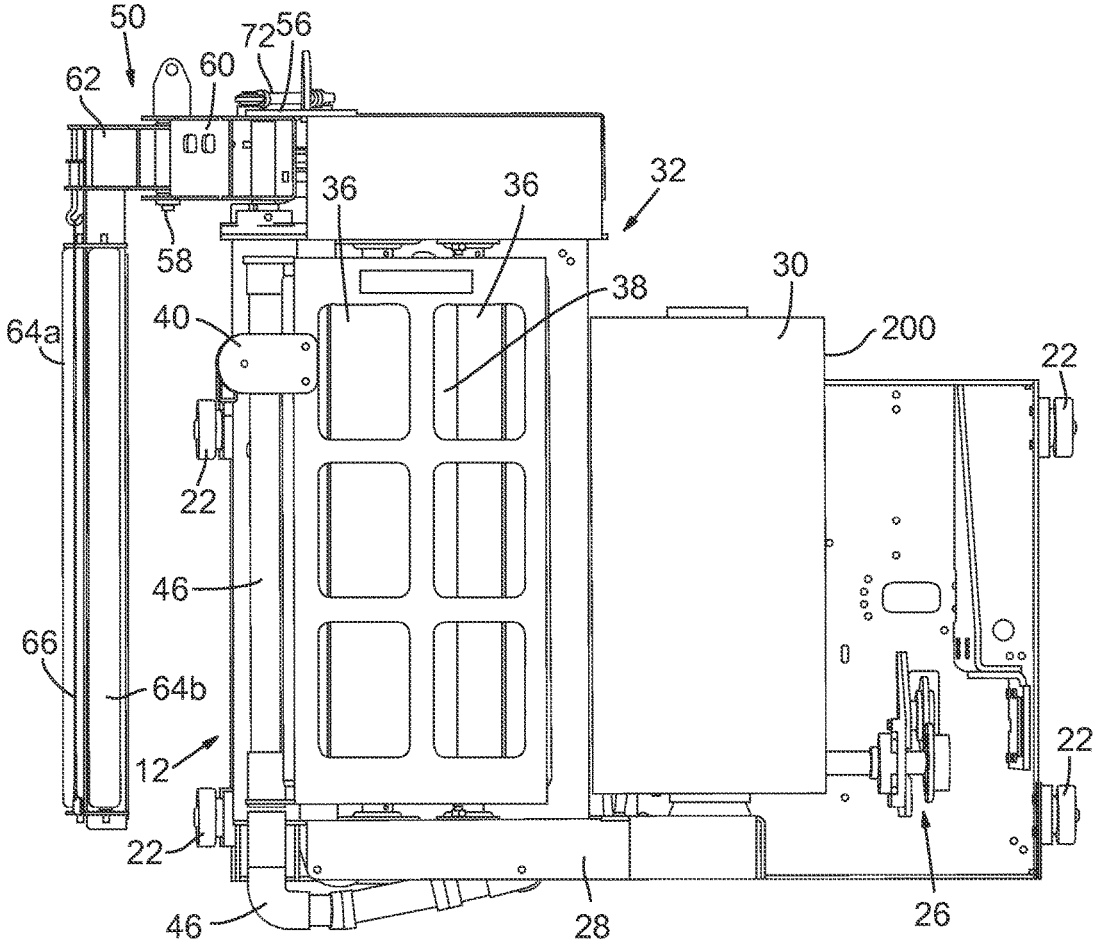
FIG. 4 is a front elevation view of the stretch wrapping head and carriage assembly shown in FIG. 3.

Once the load is completely wrapped the film 200 is cut by operation of cut arm assembly 50. The cut arm assembly 50 is shown in various positions in the drawings. In FIGS. 2, 3 and 4 the arm 52 is shown in its "home" position. In FIG. 1 the cut arm 52 is shown engaging the load after it is wrapped. In this position the downstream roller 64*a* is in contact with the film 200 after it is wrapped around the load but upstream roller 64*b* may or may not be in contact with the load. After the load is wrapped, the pressure applied to the film by roller 64*a* acts as a method of pressing the film against the load during film cut and wipe-down in combination with a brush not shown.

The cut arm 52 swings out from the home position (FIG. 2) with drive motor 68, which as noted is attached to the first end 54 of cut arm 52 with connecting rod 72, which is in turn connected to bell crank 70. As the cut arm swings from its home position the downstream roller 64*a* makes contact with the load (as shown in FIG. 1) and upon contact with the load the outer portion of arm 52 (i.e., second arm section 62) pivots against gas strut 74. Pressure from gas strut 74 keeps the roller 64*a* arm in contact with the load. When the second arm section 62 is at about 90 degrees to the carriage assembly 14 (FIG. 1) and the wrapping cycle is complete, the hot cut wire 66 is energized, heating the wire and thereby cutting the film while the cut arm 52 continues to swing to its end of travel of about 170 degrees. At this point the film 200 is deflected across the upstream and downstream rollers 64*a* and 64*b*; the close proximity of the hot wire 66 to the film, even if no actual contact is made between the film and the wire, causes the film to be cut. Moreover, avoiding direct contact between the wire and the film can be advantageous to avoid residual melted film from building up on the wire. The downstream roll 64*a* contacts the load and thus presses the cut edge of the film onto the load and this avoids a loose film end. A wiper brush (not shown) is included downstream of the downstream roller 64*a* to ensure that the cut end of the film is pressed down on the load.

Figure 5:
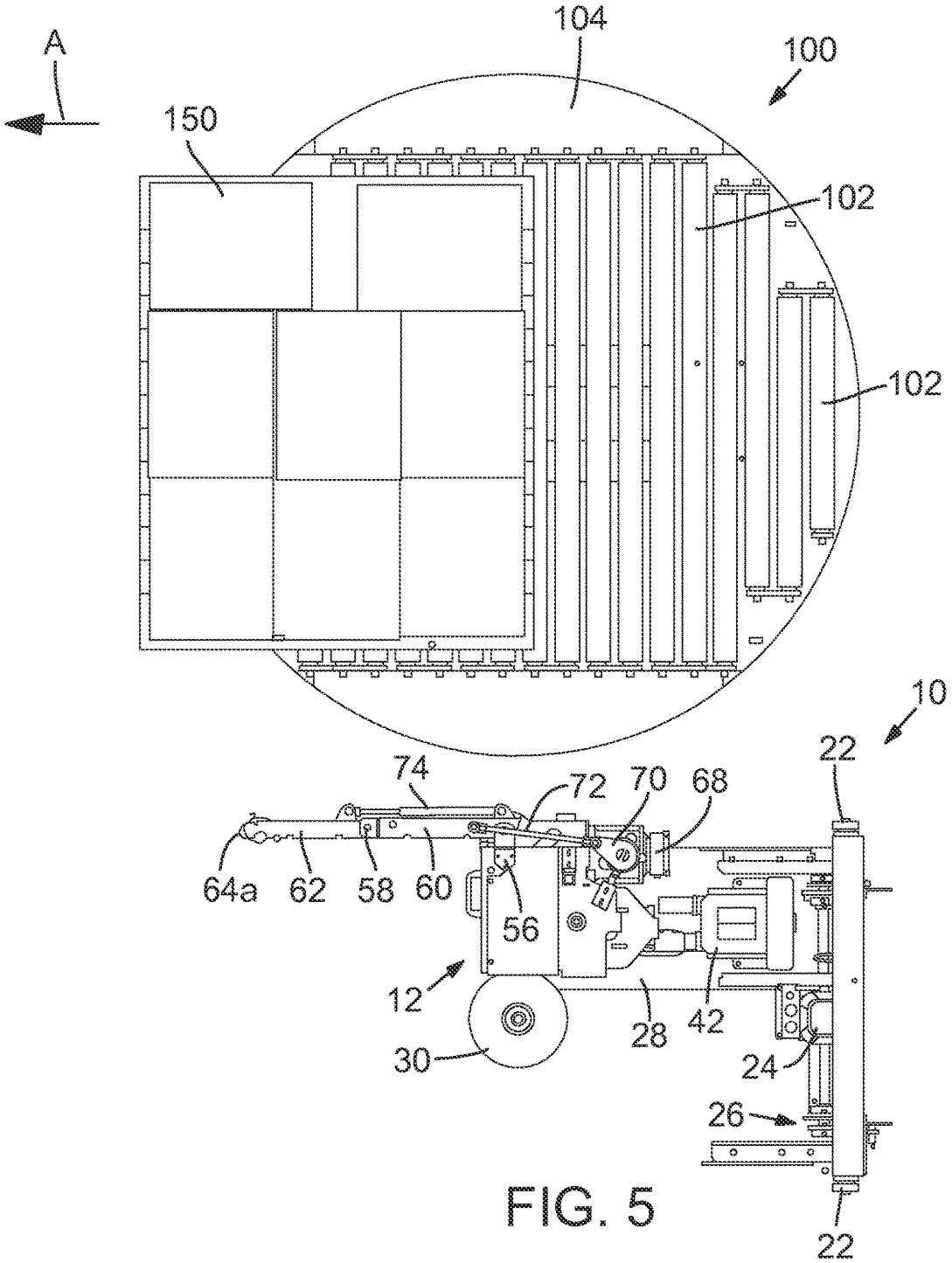
FIG. 5 is a top plan view of a stretch wrapping apparatus similar to the view of FIG. 1, except in FIG. 5 the stretch wrapping is complete and the film has been cut by the cut arm and the palletized load is exiting from the turntable.

Once cut arm 52 is at the end of its travel as shown in FIG. 5, the load starts to exit the turntable (driven off the turntable with driven rollers 102 in the direction of arrow A). The cut arm 52 is then free to swing back after the load has passed to its home position. The drive motor 68 and thus the bell crank 70 each do one complete revolution per full cut arm 52 cycle. This system is fast and provides an excellent cut and wipe regardless of the load size. The arm geometry allows wiping loads anywhere from 52×52 inches to 30×30 inches without any adjustment with the film cut preferably occurring at approximately the center of the side exposed to the cut arm, but adjustable to any point where the film cut arm is contacting the film. The load contacting rollers 64*a* and 64*b* have dual purposes: first, they provide rotational low friction contact with the load, and second, they provide protection for the heated cut wire that resides between the rollers.

By comparing the position of the cut arm 52 in its home position in FIG. 1 versus the exit position of FIG. 5, it may be seen that the arm is capable of traveling through an arc of about 170 degrees; this arc is facilitated by the articulating joint 58 between the first and second arm sections 58 and 60. In this arc the roll 64*a* goes from an engaged position with the load to a non-engaged position and the arc self-adjusts while in the engaged position to maintain pressure on the load as it rotates relative to the arm.

Those of skill in the art will readily appreciate that invention described herein and illustrated in the drawings may be modified in certain manners to create equivalent equipment without departing from the nature of the invention. For example, while the invention has been described as used with a turntable on which a palletized load is positioned, it is equally possible to create the required relative rotational motion between the load and the stretch wrapping head by keeping the load stationary and by rotating the stretch wrapping head around the stationary load. Accordingly, the term rotational axis is used herein to describe the center point for both a of these different methods of creating relative rotation between the load and the head, i.e., (a) where a stationary head used in combination with a rotating load, and (b) where a stationary load used in combination with a rotating head.

As another example, the pre-stretch assembly 32 may be modified such that the last pre-stretch roller (i.e., the most downstream roller in terms of film dispensing direction) is positioned such that film exits the roller without a downstream idler roller. This is done by canting the assembly so that film is fed directly off the last pre-stretch roller into the space between the air tubes 44, 46. As an example of yet another equivalent modification, the blower motor 42 is a source of relatively higher pressure air that is blown through the air jets 48. The higher pressure air may be supplied in numerous additional ways, for instance, a canister of pressurized air to name but one of many examples. Other modifications will be apparent to those of skill in the art.

The present invention has been described in terms of preferred and illustrated embodiments, it will be appreciated by those of ordinary skill that the spirit and scope of the invention is not limited to those embodiments, but extend to the various modifications and equivalents as defined in the appended claims.

The invention claimed is:

1. An apparatus for stretch wrapping a load supported on a surface, comprising:

a vertically movable dispensing head having at least one pair of pre-stretch rollers adapted for dispensing film, said film having a free end;

a first drive mechanism for driving the pre-stretch rollers in order to dispense film at a known payout rate;

a source of pressured air blowing through air jets trained on the film as it is dispensed from the pre-stretch rollers, thereby blowing the free end of the film toward the load;

a second drive mechanism adapted to provide relative rotation between the surface and the dispensing head;

wherein said film attaches to said load when said film makes sustained contact with an outer surface of said load due to relative rotation between the load and dispensing head.

2. An apparatus according to claim 1 wherein: (a) the length and width of the load, the distance between the dispensing head and the rotational axis, and the corners of the load are known; (b) the rate of relative rotation is known; and (c) the film payout rate is determined by and consistent with a calculated film demand.

3. An apparatus according to claim 2 wherein said film is dispensed at a film payout rate that is based upon the calculated film demand.

4. An apparatus according to claim 1 wherein said free end of the film results from a break in said film during a wrapping cycle.

5. An apparatus according to claim 4 including a sensor adapted to detect the presence of said film.

6. An apparatus according to claim 5 wherein said sensor is adapted to detect said break in the film between the dispensing head and the load.

7. An apparatus according to claim 6 wherein if the sensor detects a break in said film, the film payout rate is adjusted based upon the known relative rate of rotation so that said film reattaches to said load when said film makes contact with said load.

8. An apparatus according to claim 7 wherein the film wrap sequence is adjusted to overwrap portion of load where film defect was encountered.

9. An apparatus for stretch wrapping a load, comprising:

a surface for supporting said load, said load having known dimensions;

a dispensing head having a at least one pair of driven pre-stretch rollers adapted for dispensing a free end of film;

a drive mechanism configured to provide relative motion between said surface and said dispensing head;

a source of pressurized air blown through air jets directed toward said film as it is dispensed from the pre-stretch rollers, thereby blowing a free end of the film toward the load;

a controller for controlling the rate at which film is dispensed from the pre-stretch rollers based upon a known speed of relative rotation between said load and said dispensing head;

wherein said free end of said film attaches to said load when said free end makes contact with said load.

10. An apparatus according to claim 9 wherein said drive mechanism is causing relative rotation between said load and said dispensing head when said free end of said film attaches to an outer surface of said load.

11. An apparatus according to claim 10 including a sensor for determining the presence and absence of film.

12. An apparatus according to claim 11 wherein the presence or absence of film is determined by an optical characteristic detected by said sensor.

13. An apparatus for stretch wrapping a load, comprising:

a vertically movable dispensing head having at least one pair of pre-stretch rollers adapted for dispensing film, said film having a free end;

a first drive mechanism for driving the pre-stretch rollers in order to dispense film at a known payout rate;

a source of pressured air blowing through air jets trained on the film as it is dispensed from the pre-stretch rollers, thereby blowing the free end of the film toward the load;

a second drive mechanism adapted to provide relative rotation between the load and the dispensing head, wherein the relative rotation between the load and the dispensing head defines a rotational axis;

wherein said film attaches to said load when said film makes sustained contact with an outer surface of said load due to relative rotation between the load and dispensing head;

wherein (a) the length and width of the load, the distance between the delivery head and the rotational axis, and the corners of the load are known; (b) the rate of relative rotation is known; and (c) the film payout rate is determined by and consistent with a calculated film demand.

* * * * *